US005813298A

United States Patent [19]

Beattie

[11] Patent Number: 5,813,298

[45] Date of Patent: Sep. 29, 1998

[54] HAND TOOL TORQUE SOCKET

[76] Inventor: Robert L. Beattie, 1730 Moreno Dr., Simi Valley, Calif. 93063

[21] Appl. No.: 772,757

[22] Filed: Dec. 23, 1996

[51] Int. Cl.[6] ..... B25B 23/157

[52] U.S. Cl. ..... 81/475; 81/476

[58] Field of Search ..... 81/473–476

[56] References Cited

U.S. PATENT DOCUMENTS 4,346,633 8/1982 Rendl ..... 81/475
4,964,319 10/1990 Chang ..... 81/475 X

FOREIGN PATENT DOCUMENTS 884780 7/1953 Germany ..... 81/475

OTHER PUBLICATIONS

IBM Technical Disclosure Bulletin, vol. 24, No. 2, Universal Troque control screwdriver, Jul. 1981.

*Primary Examiner*—James G. Smith

*Attorney, Agent, or Firm*—Roger A. Marrs

[57] ABSTRACT

A torque tool which interfaces between a standard drive socket tool and a fastener intended to be tightened which includes an elongated cylinder having a movable element at one end intended to insertably receive a connection with the standard drive socket tool and a coupler movably carried at the opposite end of the cylinder for detachably connecting with a conventional socket to which the fastener is coupled. Inbetween the coupler and the socket tool connection, there is provided a preset torque device which establishes a torque range insuring that the fastener will not be tightened either too tight nor too loose. This device is an expansion helical spring and bears against a gear arranged in rotary sliding relationship with respect to the coupler for joining with the socket engaging the fastener. The member receiving the drive socket tool includes gear teeth which, in combination with the above-mentioned gear, are splined with internal gear teeth formed in the cylinder to house the torque range device.

7 Claims, 2 Drawing Sheets

HAND TOOL TORQUE SOCKET

BACKGROUND OF THE INVENTION

1. Field of the Invention

The present invention relates to the field of torque wrenches, and more particularly to a novel torque wrench designed to tighten fasteners to a certain torque specification.

2. Brief Description of the Prior Art

Conventionally, a variety of torque wrenches have been employed in various mechanical assembling operations to tighten nuts and bolts rapidly and at the same time, to ensure that the parts have been joined together to produced a desired holding action without applying an excessive degree of torque which would tend to weaken or fracture the threads or holding elements of the parts being tightened. Various attempts have been employed to supply special torque wrenches to operate in connection with tightening of parts whereby the degree of torque applied by a wrench is indicated either visually or by feel. Devices of this character tend to increase the coordination and efficiency of the operator and it has been found desirable to provide means which will indicate automatically when the selected amount of torque has been applied. This desired indication is usually assembled or constructed with a torque wrench itself which includes a handle grip of the wrench so that the operator will be alerted to the amount of torque being applied.

Further problems have been encountered with employing conventional torque wrenches, which stem largely from the fact that such wrenches are expensive and are not suitable for a single size of fastener to which torque is applied. In most instances, such torque wrenches must further include means for adjusting the value of torque being applied. Therefore, either an extensive set of torque wrenches is needed or specially designed torque wrenches must be used to accommodate sizing.

Therefore, a long-standing need has existed to provide a novel torqing device which is designed to tighten fasteners to certain torque specifications. Such a novel torque tool or device must have a preset torque range built into the device which cannot be altered by the user and the device should be adaptable to operate between a fastener and a standard drive socket tool.

SUMMARY OF THE INVENTION

Accordingly, the above problems and difficulties are avoided by the present invention which provides a novel torque tool or device which interfaces between a standard drive socket tool and the fastener intended to be tightened. In one form of the invention, an elongated cylinder is provided having a movable element at one end intended to insertably receive a connection with the standard drive socket tool and a coupler movably carried at the opposite end of the cylinder for detachably connecting with a conventional socket to which the fastener is coupled. In between the coupler and the socket tool connection, there is provided a preset torque means which establishes a torque range ensuring that the fastener will not be tightened either too tight nor too loose. In one form, this means is an expansion helical spring and bears against a gear arranged in rotary sliding relationship with respect to the coupler for joining with the socket engaging the fastener. Also, the member receiving the drive socket tool includes gear teeth which, in combination with the above-mentioned gear, are splined with internal gear teeth formed in the cylinder housing the present torque range means.

Therefore, it is among the primary objects of the present invention to provide a novel torquing device which has a preset torque range internally built in and which cannot be altered by the user and will give the user ranges of torque in foot pounds to choose from to meet fastener's specifications.

Another object of the present invention is to provide a torque tool which is designed to be adapted to use with standard drive socket tools and which has a female adaptor on one end for accepting drive ratches or breaker bars. The other end of the device includes a male adaptor that drives a socket of choice selected for use on a specific fastener size.

Yet another object of the present invention is to provide a hand tool interfaced between a conventional drive socket wrench or tool and a fastener socket that is adaptable to a ratchet or a breaker bar and a drive socket.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
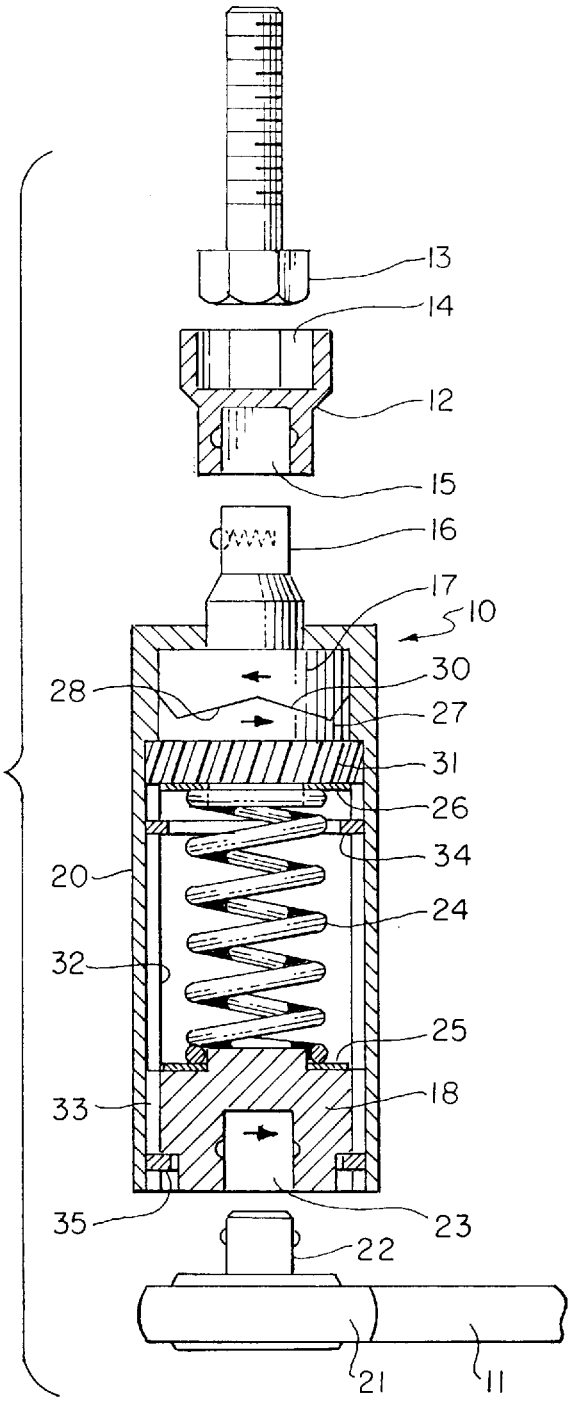
FIG. 1 is a longitudinal cross-sectional view of the novel torque device incorporating the present invention.

Referring to FIG. 1, the novel torque device of the present invention is illustrated in the general direction of arrow 10 which is disposed between a hand tool, such as a wrench 11, and an accessory or standard socket 12. A fastener intended to be driven into a work piece is identified by numeral 13 and includes a head which fits into the hexagon-shaped recess of the socket 12 and the recess is indicated by numeral 14. The opposite end of the socket includes a cavity 15 into which a stud 16 carried on the end of a driven plate 17 is carried. A drive plate is indicated by numeral 18 and is located at the opposite end of the torque device 10 from the end carrying the driven plate 17. All of the components of the torque device are carried by a cylindrical housing 20 which has a cavity occupied by the components. The drive plate 18 is turned by detachable connection with a ratchet 21 carried on the end of wrench 11 via a stud 22 which fits into cavity 23 in the drive plate 18. The ratchet may be carried on the end of a hand tool, such as the wrench 11, or may be carried on a breaker bar or a power tool.

Within the housing 20, there is provided a compressed helical spring 24 that rests on top of a washer 25 carried on the internal side of the drive plate 18. The other end of the spring 24 bears against the washer 26 which bears against the underside of a spring plate 27 that forces the spring plate into mesh with the driven plate 17. It is to be noted that the opposing surfaces of the spring plate and the driven plate are irregular and constitute a series of sloping ramps. The irregular surface of the driven plate 17 is indicated by numeral 28 while the irregular surface of the spring plate is indicated by numeral 30. The spring plate and the driven plate are intended to move in unison when rotated until such time as the spring tension exerts itself to cause relative movement between the spring plate and the driven plate to change. The driven plate is rotated via the spring plate by means of meshed gears with splines 32. The driven gear teeth are indicated by numeral 31 while the driving splines are indicated by a spiral arrangement of ridges carried on the inside of the bore of the cylindrical housing 20 and such ridges or splines are indicated by numeral 32. The drive plate 18 also includes gear teeth which are meshed with the splines 32 and such teeth are indicated by the numeral 33.

The snap ring 34 is employed as a limiting device. When a power tool is operating the torque device 10, the limiting snap ring 34 is removed so that rollover of the surfaces 28 and 30 can happen when spring tension is overcome. On a hand-operated torque device usage, a snap ring is installed to limit "rollover" of the ridge surfaces "point-to-point".

In order to mount the components of the torque device within the device or cylinder 20, a snap ring 35 is employed to interface between the housing and the drive plate 18. The snap ring 35 may readily be installed or removed utilizing a conventional snap ring tool.

Figure 3:
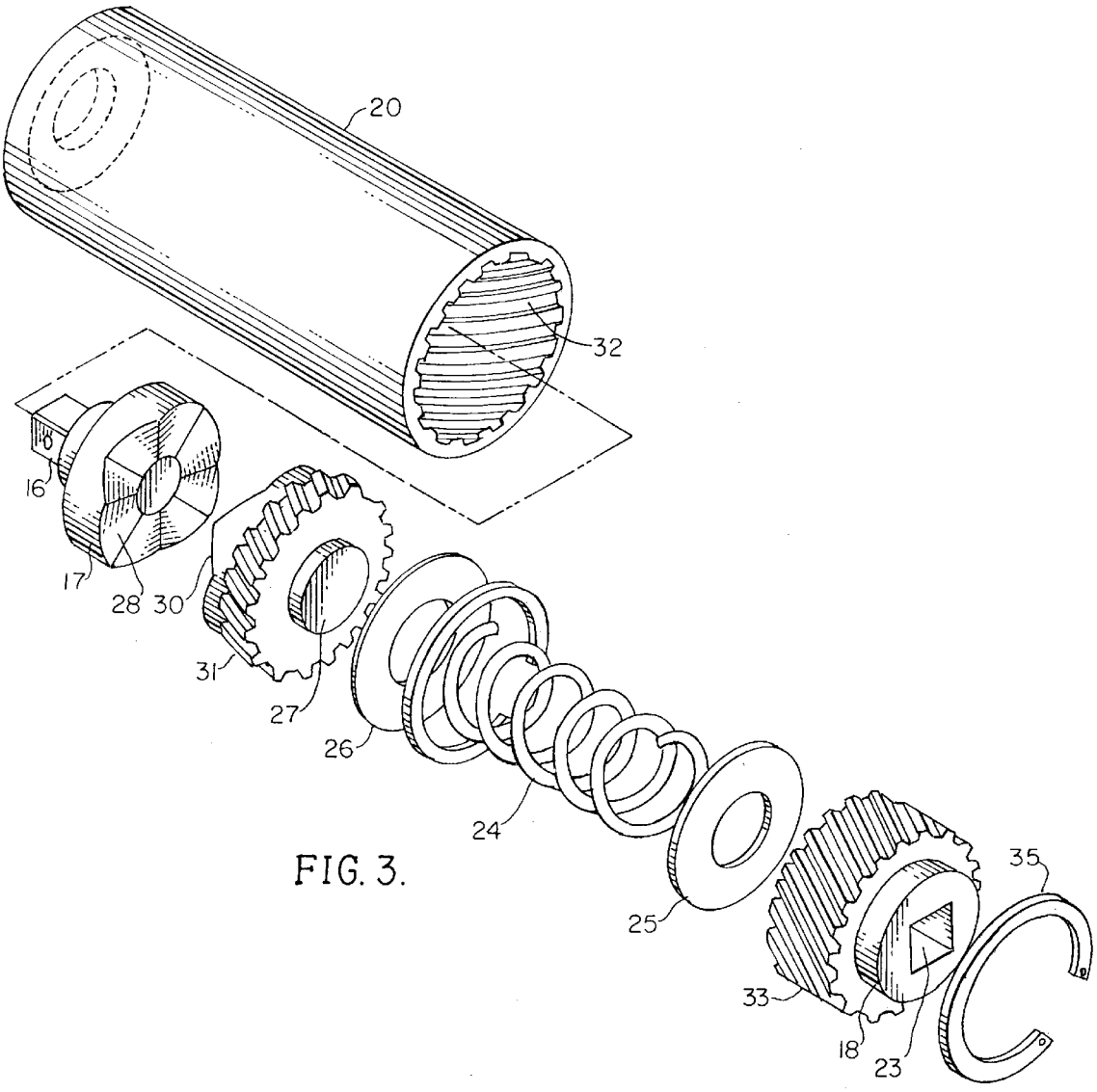
FIG. 3 is an enlarged exploded perspective view showing the novel torque device as illustrated in FIG. 1.

In actual operation, a wrench, power brake or power tool is detachably coupled to the drive plate 18 so that the drive plate is turned thereby in the direction as indicated by the arrow. Thus, the housing 20 is turned clockwise by the inner splined gearing 32 in mesh with the gear teeth 33 on the drive plate. The inner spline gear 32 may be manufactured in a clockwise spiral direction to relieve sheer force binding. The spiral arrangement of teeth is more clearly indicated in FIG. 3. The spring rate of helical spring 24 may vary in size and weight depending upon the desired torque value selected by the user.

Figure 2:
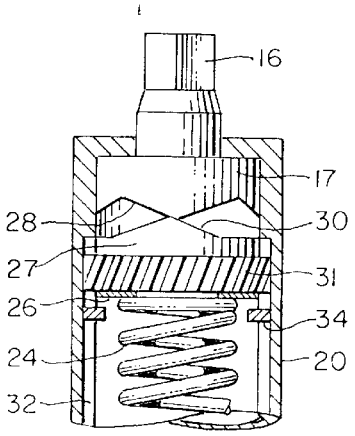
FIG. 2 is a fragmentary sectional view of the device shown in FIG. 1 illustrating relative movement between component parts.

The spring plate 27 is turned by the splined housing 20 in a clockwise direction. As the offset surfaces or ridges 28 and 30 are turned point-to-point, a downward force is applied to the spring 24. The spring plate 27 can only turn the driven plate 17 as long as the spring 24 is not overcome by the down force of the point-to-point surfaces or ridges. The spring plate slides up and down by the splines on the outer circumference, as indicated by numeral 31 with respect to the spline connection to the inner housing circumference gearing 32. FIG. 2 shows how the surfaces 28 and 30 ride and that the surfaces provide a series of sloping ramps. The driven plate 17 is held by the fastener 13 when the torque point is achieved.

The snap ring 34 is removed when a power tool is operating the torque device 10 so that the roll-over of the surfaces or ridges can occur when the spring tension is overcome. When a hand tool or hand-operated tool is attached to the torque device 10, the snap ring is installed to limit "roll-over" of the ridged surfaces "point-to-point".

By employing the torque device 10 of the present invention, tighter tolerances may be accommodated and torquing of lighter and softer composite metals can be achieved. These metals flex under load and torque conditions and care must be taken to protect the metal. Furthermore, such composite metals also expand and contract under varying heat conditions and again torquing is important. Many of the failures which occur in fastening situations are due to improper torque of fasteners.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A torque device for interfacing between a turning tool and a fastener comprising:

a cylindrical housing having open opposite ends;

a drive plate disposed in said housing adjacent one open end;

a driven plate disposed in said housing adjacent the other said open end;

means operably connected between said drive plate and said driven plate to adjustably apply a regulated torque to said driven plate in response to movement of said drive plate said means for adjustably applying a regulated torque comprise:

a spring plate bearing against said driven plate;

resilient means carried in said housing expanding against said drive plate and said spring plate and wherein said resilient means include a pre-selected spring rate;

said housing having a central bore with spiral ridges carried thereon; and each of said drive plate and said spring plate having gear teeth in mesh with said housing spiral ridges whereby rotation of said drive plate causes said driven plate to rotate via said spring plate.

2. The torque device defined in claim 1 wherein:

said spring plate and said driven plate having irregular opposing surfaces urged together in sliding relationship in response to said resilient means.

3. The torque device defined in claim 2 wherein:

said resilient means is a helical spring.

4. The torque device defined in claim 3 wherein:

said irregular surface is a series of sloping ramp surfaces radiating outwardly from the center of each of said spring plate and driven plate respectively.

5. The torque device defined in claim 4 including:

a limiting snap ring carried on said housing in spaced-apart relationship with respect to said spring plate for limiting travel of said spring plate within the bore of said housing in response to turning of said drive plate.

6. A torque device comprising:

a housing;

a driving member rotatably carried on one end of said housing;

a driven member rotatably carried on the other end of said housing;

a spring plate rotatably carried in said housing adjacent said driven member and in spaced-apart relationship with respect to said driving member;

said driven member and said spring plate having mated irregular surfaces in sliding engagement;

resilient means having a pre-set spring rate compressed between said spring plate and said driving member;

said driven member adapted to rotate in response to said driving member via said spring plate biased by said pre-set spring rate of said resilient means; and gearing means engageable between said driving member and said housing and between said housing and said spring plate.

7. The torque device of claim 6 wherein:

said gearing means is a spiral spline disposed in a central bore of said housing in mesh with slanted teeth carried on said driving member and said spring plate.

* * * * *